US010339886B2

(12) United States Patent
Jung et al.

(10) Patent No.: US 10,339,886 B2
(45) Date of Patent: Jul. 2, 2019

(54) DISPLAY PANEL HAVING GATE DRIVING CIRCUIT AND METHOD OF MONITORING CHARACTERISTICS OF GATE DRIVING CIRCUIT

(71) Applicant: LG Display Co., Ltd., Seoul (KR)

(72) Inventors: Haeyoon Jung, Goyang-si (KR); Dongyoon Kim, Paju-si (KR); Younyeol Yu, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 182 days.

(21) Appl. No.: 15/698,446

(22) Filed: Sep. 7, 2017

(65) Prior Publication Data

US 2018/0114500 A1 Apr. 26, 2018

(30) Foreign Application Priority Data

Oct. 24, 2016 (KR) ..... 10-2016-0138423

(51) Int. Cl.

| | |
|---|---|
| ***G09G 3/36*** | (2006.01) |
| ***G09G 3/3266*** | (2016.01) |
| ***G09G 3/00*** | (2006.01) |

(52) U.S. Cl.

CPC ..... *G09G 3/3677* (2013.01); *G09G 3/006* (2013.01); *G09G 3/3266* (2013.01); *G09G 3/3674* (2013.01); *G09G 3/3688* (2013.01); *G09G 2300/0408* (2013.01); *G09G 2300/0417* (2013.01); *G09G 2300/0426* (2013.01); *G09G 2300/0819* (2013.01); *G09G 2300/0871* (2013.01); *G09G 2310/0251* (2013.01); *G09G 2310/0286* (2013.01); *G09G 2310/08* (2013.01);

(Continued)

(58) Field of Classification Search

CPC .... G09G 3/006; G09G 3/3266; G09G 3/3674; G09G 3/3677; G09G 3/3688; G09G 2300/0408; G09G 2300/0417; G09G 2300/0426; G09G 2300/0819; G09G 2300/0871; G09G 2310/0251; G09G 2310/0286; G09G 2310/08; G09G 2320/0693; G09G 2320/043; G09G 2330/12

See application file for complete search history.

(56) References Cited

U.S. PATENT DOCUMENTS

2008/0211835 A1* 9/2008 Enjou ..... G09G 3/3685 345/690
2009/0273550 A1* 11/2009 Vieri ..... G09G 3/3648 345/87

(Continued)

FOREIGN PATENT DOCUMENTS

KR 10-2007-0036812 A 4/2007
KR 10-2008-0033773 A 4/2008
KR 10-2011-0068238 A 6/2011

*Primary Examiner* — Ryan A Lubit
(74) *Attorney, Agent, or Firm* — Polsinelli PC

(57) ABSTRACT

The present disclosure relates to a display panel having a gate driving circuit and a method of monitoring characteristics of the gate driving circuit, and the gate driving circuit includes a test transistor connected to at least one of a pull-up transistor and a pull-down transistor. The test transistor is turned on in response to a gate on voltage of a test enable signal generated in a measurement mode to form a closed loop including at least one of the pull-up transistor and the pull-down transistor.

20 Claims, 9 Drawing Sheets

(52) U.S. Cl.
CPC ..... *G09G 2320/043* (2013.01); *G09G 2320/0693* (2013.01); *G09G 2330/12* (2013.01)

(56) References Cited

U.S. PATENT DOCUMENTS

| | | | | |
|---|---|---|---|---|
| 2014/0226026 | A1* | 8/2014 | Claramond | G09G 3/006 348/181 |
| 2016/0043010 | A1* | 2/2016 | Kwak | H01L 22/14 257/48 |
| 2016/0293074 | A1* | 10/2016 | Yan | G09G 3/006 |
| 2017/0193901 | A1* | 7/2017 | Wang | G09G 3/3233 |
| 2018/0211612 | A1* | 7/2018 | Hong | G09G 3/36 |

* cited by examiner

DISPLAY PANEL HAVING GATE DRIVING CIRCUIT AND METHOD OF MONITORING CHARACTERISTICS OF GATE DRIVING CIRCUIT

CROSS-REFERENCE TO RELATED APPLICATION

This application claims the benefit of Korean Patent Application No. 10-2016-0138423 filed on Oct. 24, 2016, the entire contents of which are incorporated herein by reference for all purposes as if fully set forth herein.

BACKGROUND

Field of the Disclosure

The present disclosure relates to a display device, and more particularly, to a display panel having a gate driving circuit and a method of monitoring characteristics of the gate driving circuit.

Description of the Background

A display device includes a data driving circuit which supplies a data signal to data lines of a pixel array, a gate driving circuit (or scan driving circuit) which sequentially supplies a scan pulse (or scan pulse) synchronized with the data signal to gate lines (or scan lines) of the pixel array, and a timing controller which controls the data driving circuit and the gate driving circuit.

Each pixel includes a thin film transistor (TFT) which supplies a voltage of a data line to a pixel electrode in response to the gate pulse. The gate pulse swings between a gate high voltage (VGH) and a gate low voltage (VGL). The gate high voltage VGH is set to a voltage higher than a threshold voltage of a pixel TFT and the gate low voltage VGH is set to a voltage lower than the threshold voltage of the pixel TFT.

Recently, a technique for embedding the gate driving circuit with the pixel array in a display panel has been developed. Hereinafter, the gate driving circuit embedded in the display panel is referred to as "gate in panel (GIP)". A GIP circuit includes a shift register. The shift register includes a plurality of cascade-connected states and shifts an output voltage at shift clock timing. Each stage of the shift register includes a pull-up transistor T1 which charges an output terminal OUT(n) in response to a voltage of a Q node to increase an output voltage, a pull-down transistor T2 which discharges the output terminal OUT(n) in response to a voltage of a QB node to decrease the output voltage, and a switch circuit which charges and discharges the Q node and the QB node, as shown in FIGS. 1 and 2. The output terminal OUT(n) is connected to a gate line of the display panel. The output voltage is applied to the gate line as an n-th gate pulse.

The pull-up transistor T1 charges the output terminal with the voltage VGH of a shift clock CLK when the shift clock CLK is input to the drain when the Q node is pre-charged by the gate high voltage VGH. The pull-down transistor T2 connects the output terminal to a GVSS terminal to which the gate low voltage VGL is applied when the QB voltage is charged by VGH to discharge the voltage Vout(n) of the output terminal to VGL. A switch circuit 2 charges the Q node in response to a set signal SET and discharges the Q node in response to a reset signal RST. The switch circuit 2 charges/discharges the QB node in a manner contrary to the manner of charging/discharging the Q node using an inverter. The set signal SET may be a start pulse or a carry signal input from the previous stage. The reset signal RST may be a reset signal for simultaneously initializing all stages or a carry signal input from the next stage.

Transistors constituting the GIP circuit can be implemented as TFTs with a metal oxide semiconductor field effect transistor (MOSFET) structure. The GIP circuit is formed along with the TFTs of the pixel array on the substrate of the display panel through the same manufacturing process and thus has a similar structure to the TFTs of the pixel array. The transistors of the GIP circuit are formed concurrently with a TFT array of the pixel array directly on the substrate of the display panel through the same manufacturing process. In the case of a full high definition (FHD) display device, 1,080 gate lines and a GIP circuit connected to the gate lines are arranged on the substrate of the display panel. In a large display device such as a TV, the GIP circuit may be arranged on both sides of the display panel in order to reduce RC delay of a gate pulse waveform.

In the GIP circuit, the pull-up transistor T1 and the pull-down transistor T2 require high current driving capability and thus they are larger than other transistors constituting the switch circuit 2 and have different driving characteristics from the other transistors.

Since the GIP circuit is directly formed on the substrate of the display panel, defects in the GIP circuit largely affect the yield of the display panel. To solve this problem, a method for monitoring characteristics of the GIP circuit is required. However, it is difficult to measure transistor characteristics of the GIP circuit without destructive analysis of the display panel. Particularly, since the pull-up transistor and the pull-down transistor which directly output gate pulses in the GIP circuit largely affect the performance and life of the display panel, it is important to measure characteristics thereof.

In the case of a high definition model, a method of manufacturing a GIP circuit using an oxide TFT including an oxide semiconductor having high mobility has been studied. Characteristics of the oxide TFT can be easily changed by varying the concentrations of hydrogen and oxygen to which the oxide TFT is exposed during the manufacturing process. When the hydrogen content in the oxide semiconductor increases, a threshold voltage Vth negatively shifts due to a doping effect. Oxide TFT characteristic deviation is generated according to the hydrogen content of a nitride film ($SiN_x$) or an oxide film ($SiO_2$) used as a lower inorganic film on a display panel substrate of an organic light-emitting diode (OLED) display, and such characteristic deviation increases as TFT size increases. It is difficult to control characteristics of a large oxide TFT in the GIP circuit. In the case of a flexible panel, oxide TFT characteristics vary according to the characteristics of an inorganic film added to a polyimide (PI) substrate. Accordingly, it is difficult to stabilize oxide TFT characteristics, and thus a method for monitoring the oxide TFT characteristics is required.

SUMMARY

The present disclosure provides a display panel having a gate driving circuit which can measure characteristics of a large-size transistor in a GIP circuit without destructive analysis of the display panel and a method of monitoring characteristics of the gate driving circuit.

Additional features and advantages of the present disclosure will be set forth in the description which follows and in part will be apparent from the description, or may be learned by practice of the disclosure. Other advantages of the disclosure will be realized and attained by the structure particularly pointed out in the written description and claims hereof as well as the appended drawings.

To achieve these and other advantages and in accordance with the purpose of the present disclosure, as embodied and broadly described, a display panel of the present disclosure includes a pull-up transistor connected to a clock line to which a clock signal is applied and turned on in response to a voltage of a Q node to increase a voltage of a gate line, a pull-down transistor turned on in response to a voltage of a QB node to connect the gate line to a low voltage line to which a gate off voltage is applied to decrease the voltage of the gate line, and a test transistor connected to at least one of the pull-up transistor and the pull-down transistor. The pull-up transistor, the pull-down transistor and the test transistor are arranged on a substrate of the display panel along with transistors of a pixel array displaying an input image. The test transistor is turned on in response to a gate on voltage of a test enable signal generated in a measurement mode to form a closed loop including at least one of the pull-up transistor and the pull-down transistor.

In another aspect of the present disclosure, a display panel comprising at least one gate driving circuit, a data driving circuit and a pixel array, the at least one gate driving circuit and the data driving circuit respectively connected to the pixel array by a gate line and a data line, the at least one gate driving circuit includes a pull-up transistor connected to a clock line and turned on by a voltage of a Q node and increasing a voltage of the gate line; a pull-down transistor connecting the gate line to a low voltage line where a gate off voltage is applied, turned on by a voltage of a QB node and decreasing the voltage of the gate line; and at least one test transistor connected to at least one of the pull-up transistor and the pull-down transistor and turned on by a gate on voltage of a test enable signal generated in a measurement mode, wherein the pull-up transistor and the pull-down transistor form a closed loop when a resistance of the closed loop is measured in the measurement mode and the resistance of the closed loop is used to determine if at least one of the pull-up transistor and the pull-down transistor is defective.

The substrate includes first and second gate driving circuits. Each of the first and second gate driving circuits includes a plurality of pull-up transistors, a plurality of pull-down transistors and at least one test transistor.

The test transistor is turned on in response to the gate on voltage of the test enable signal in the measurement mode. The test transistor includes a gate to which the test enable signal is applied, a first electrode to which a test control voltage is applied, and a second electrode connected to the Q node. The test control voltage is set to a linear operation voltage of the pull-up transistor.

The closed loop includes a first clock line connected to the first gate driving circuit, the pull-up transistor of the first gate driving circuit, the gate line, the pull-up transistor of the second gate driving circuit, and a clock line connected to the second gate driving circuit. The resistance of the closed loop is measured by a measurement device in the measurement mode.

The test transistor is turned on in response to the gate on voltage of the test enable signal generated in the measurement mode. The test transistor includes a gate to which the test enable signal is applied, a first electrode connected to the QB node and a second electrode to which the test control voltage is applied. The test control voltage is set to a linear operation voltage of the pull-down transistor.

The closed loop includes a low voltage line connected to the first gate driving circuit, the pull-down transistor of the first gate driving circuit, the gate line, the pull-down transistor of the second gate driving circuit, and a low voltage line connected to the second gate driving circuit. The resistance of the closed loop is measured by a measurement device in the measurement mode.

The test transistor includes first and second transistors turned on in response to the gate on voltage of the test enable signal generated in the measurement mode. The first transistor includes a gate to which the test enable signal is applied, a first electrode to which the test control voltage is applied and a second electrode connected to the Q node. The second transistor includes a gate to which the test enable signal is applied, a first electrode connected to the QB node and a second electrode to which the test control voltage is applied. The test control voltage is set to linear operation voltages of the pull-up transistor and the pull-down transistor.

The closed loop includes: a first closed loop including a clock line connected to the first gate driving circuit, the pull-up transistor of the first gate driving circuit, the pull-down transistor of the first gate driving circuit and a low voltage line connected to the first gate driving circuit; and a second closed loop including a clock line connected to the second gate driving circuit, the pull-up transistor of the second gate driving circuit, the pull-down transistor of the second gate driving circuit and a low voltage line connected to the second gate driving circuit. The resistances of the first and second closes loops are measured by a measurement device in the measurement mode.

A method of monitoring characteristics of a gate driving circuit according to an aspect of the present disclosure includes: forming a closed loop including at least one of the pull-up transistor and the pull-down transistor using a transistor connected to at least one of the pull-up transistor and the pull-down transistor; measuring resistance of the closed loop; and determining whether at least one of the pull-up transistor and the pull-down transistor is defective on the basis of the resistance of the closed loop.

It is to be understood that both the foregoing general description and the following detailed description are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this specification, illustrate aspects of the disclosure and together with the description serve to explain the principles of the disclosure.

In the drawings.

DETAILED DESCRIPTION

Figure 1:
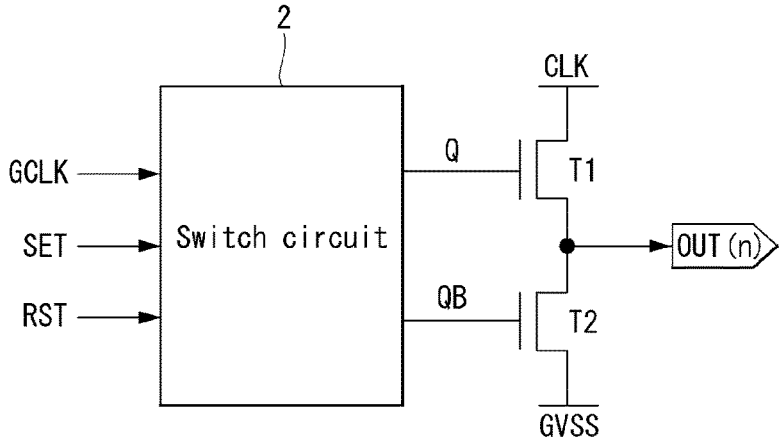
FIG. 1 RELATED ART
FIG. 1 is a schematic diagram illustrating one stage of a shift register of a gate driving circuit according to the related art.
Figure 2:
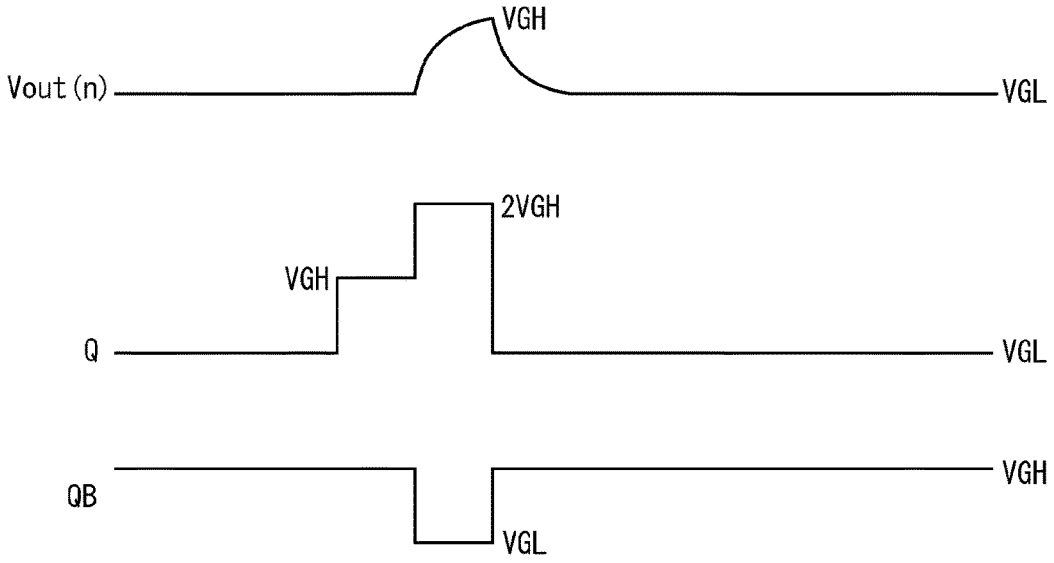
FIG. 2 RELATED ART
FIG. 2 is a waveform diagram illustrating a voltage of a Q node, a voltage of a QB node and an output voltage shown in FIG. 1.

The advantages, features and methods for accomplishing the same of the present disclosure will become more apparent through the following detailed description with respect to the accompanying drawings. However, the present disclosure is not limited by aspects described blow and is implemented in various different forms, and the aspects are provided so that this disclosure will be thorough and complete, and will fully convey the scope of the disclosure to those skilled in the art. The present disclosure is defined by the scope of the claims.

Shapes, sizes, ratios, angles, numbers, etc. shown in the figures to describe aspects of the present disclosure are exemplary and thus are not limited to particulars shown in the figures. Like numbers refer to like elements throughout the specification. In describing the present disclosure, if a detailed description of known techniques associated with the present disclosure would unnecessarily obscure the gist of the present disclosure, detailed description thereof will be omitted. It will be further understood that the terms "include", "have" and "comprise" when used in this specification specify the presence of stated features, regions, integers, steps, operations, elements, and/or components, but do not preclude the presence or addition of one or more other features, regions, integers, steps, operations, elements, components, and/or groups thereof. An element described in the singular form is intended to include a plurality of elements unless context clearly indicates otherwise.

In interpretation of a component, the component is interpreted as including an error range unless otherwise explicitly described.

It will be understood that, when an element is referred to as being "on" or "under" another element, it can be "directly" on or under another element or can be "indirectly" formed such that an intervening element is also present.

In the following description of the aspects, "first" and "second" are used to describe various components, but such components are not limited by these terms. The terms are used to discriminate one component from another component. Accordingly, a first component mentioned in the following description may be a second component within the technical spirit of the present disclosure.

Features of aspects of the present disclosure can be coupled or combined partially or overall and technically interoperated in various manners, and the aspects may be implemented independently or associatively.

A display device of the present disclosure may be implemented as a flat panel display such as a liquid crystal display (LCD) or an OLED display device. Although a description will be given on the basis of an LCD in the following aspects, the present disclosure is not limited thereto. For example, the present disclosure is applicable to any display device including a GIP circuit.

In a gate driving circuit of the present disclosure, switch elements may be implemented as n-type or p-type metal oxide semiconductor field effect transistors (MOSFETs). Although n-type transistors are exemplified in the following aspects, the present disclosure is not limited thereto. A transistor is a 3-electrode element including a gate, a source and a drain. The source is an electrode which supplies carriers to the transistor. Carriers flow from the source into the transistor. The drain is an electrode through which carriers flow out of the transistor. That is, carriers flow from the source to the drain in the MOSFET. In the case of an n-type MOSFET (NMOS), carriers are electrons and thus a source voltage is lower than a drain voltage such that electrons flow from the source to the drain. Since electrons flow from the source to the drain in the n-type MOSFET, current flows from the drain to the source. In the case of a p-type MOSFET (PMOS), carriers are holes and thus a source voltage is higher than a drain voltage such that holes flow from the source to the drain. Since holes flow from the source to the drain in the p-type MOSFET, current flows from the source to the drain. It is noted that the source and the drain of the MOSFET are not fixed. For example, the source and the drain of the MOSFET can be changed according to applied voltage. In the following description of aspects, the source and the drain of the transistor are called a first electrode and a second electrode. It is noted that the disclosure is not limited by the source and the drain of the transistor in the following description.

Transistors which constitute the gate driving circuit of the present disclosure can be implemented as one or more of a transistor including an oxide semiconductor, a transistor including amorphous silicon (a-Si) and a transistor including low temperature polysilicon (LTPS).

A display panel of the present disclosure includes at least one gate driving circuit (GIP circuit) which is arranged on a display panel and includes a pull-up transistor connected to a clock line to which a clock signal is applied and turned on in response to a voltage of a Q node to increase a voltage of a gate line, and a pull-down transistor turned on in response to a voltage of a QB node to connect the gate line to a low voltage line (GVSS line) to which a gate off voltage is applied to decrease the voltage of the gate line.

The present disclosure forms a closed loop including at least one of the pull-up transistor and the pull-down transistor using a transistor connected to at least one of the pull-up transistor and the pull-down transistor and measures resistance of the closed loop in a GIP characteristic measurement mode. In addition, the present disclosure determines whether at least one of the pull-up transistor and the pull-down transistor is defective on the basis of the resistance of the closed loop.

The present disclosure can adjust voltages applied to the pull-up transistor and the pull-down transistor on the basis of a result of measurement of resistance of at least one of the pull-up transistor and the pull-down transistor.

Aspects of the present disclosure will be described with reference to the attached drawings. Like numbers refer to like elements throughout the specification. In the following, if a detailed description of known techniques associated with the present disclosure would unnecessarily obscure the gist of the present disclosure, detailed description thereof will be omitted.

Figure 3:
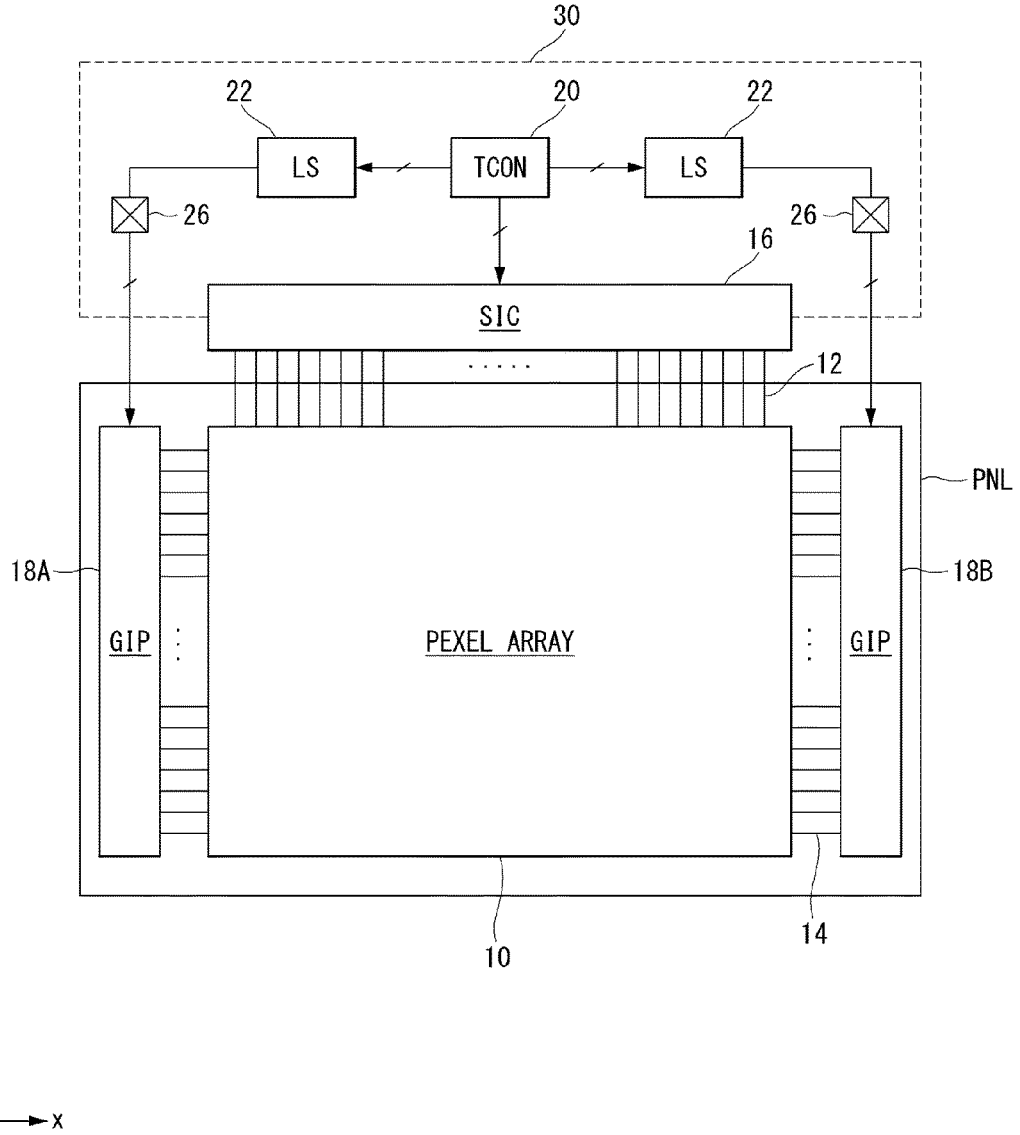
FIG. 3 is a block diagram of a display device according to an aspect of the present disclosure.

Referring to FIG. 3, a display device of the present disclosure includes a display panel PNL and a display panel driving circuit for writing data of an input image to a pixel array of the display panel PNL.

The display panel PNL includes data lines 12, gate lines 14 intersecting the data lines 12, and a pixel array in which pixels are arranged in a matrix form defined by the data lines 12 and the gate lines 14. The input image is displayed on the pixel array.

The pixels of the pixel array may include red (R), green (G) and blue (B) sub-pixels to express colors. Each pixel may further include a white (W) sub-pixel in addition to RGB sub-pixels.

The pixel array of the display panel PNL can be divided into a TFT array and a color filter array. The TFT array can be formed on the lower substrate of the display panel PNL. The TFT array includes TFTs formed at the intersections of the data lines 12 and the gate lines 14, pixel electrodes charging data voltages, and storage capacitors Cst connected to the pixel electrodes and maintaining the data voltages.

The color filter array can be formed on the upper substrate or the lower substrate of the display panel PNL. The color filter array includes a black matrix, a color filter, etc. In the case of a COT (Color Filter on TFT) or TOC (TFT on Color Filter) model, the color filter and the black matrix may be arranged along with the TFT array on the same substrate.

A touchscreen using an in-cell touch sensor may be provided on the display panel PNL. The in-cell touch sensor is embedded in the pixel array of the display panel PNL. On-cell type touch sensors or add-on type touch sensors may be arranged on the display panel PNL. The touch sensors may be implemented as capacitive touch sensors, for example, mutual capacitance sensors or self-capacitance sensors.

The display panel driving circuit includes a data driver 16 and a gate driver 22, 18A and 18B and writes data of an input image to the pixels of the display panel PNL. The gate driver 22, 18A and 18B includes a GIP circuits 18A and 18B arranged on the substrate of the display panel PNL, a timing controller 20 and a level shifter LS 22 arranged between the GIP circuits 18A and 18B.

The data driver SIC includes at least one source drive IC. The source drive IC may be mounted on a COF (Chip-On-Film) and connected between the display panel PNL and a PCB (Printed Circuit Board) 30. The source driver IC SIC may be directly attached to the substrate of the display panel PNL through a COG (Chip-On-Glass) process.

The data driver SIC converts digital video data of an input image received from the timing controller TCON 20 into a gamma compensation voltage and outputs a data voltage. The data voltage output from the data driver SIC is supplied to the data lines 12. A multiplexer which is not shown may be arranged between the data driver SIC and the data lines 12. The multiplexer distributes the data voltage input from the data driver SIC to the data lines 12 under the control of the timing controller TCON. A 1:3 multiplexer time-divides a data voltage input through a single output channel and supplies the data voltage to two data lines. When the 1:3 multiplexer is used, the number of channels of the data driver SIC can be reduced to 1/3.

The gate driver 22, 18A and 18B generates a gate pulse signal synchronized with the data voltage using a shift register, that is, the GIP circuits 18A and 18B and shifts the gate pulse signal at shift clock timing.

The level shifter LS shifts the voltage of a gate timing control signal received from the timing controller 20 to VGH and VGL and outputs the shifted voltages to the GIP circuits 18A and 18B.

The GIP circuits 18A and 18B may be formed at a bezel BZ of one edge of the display panel PNL outside the pixel array or formed at bezels of both edges thereof. The first GIP circuit 18A is connected to one side of the gate lines 14 and sequentially supplies the gate pulse signal to the gate lines 14. The second GIP circuit 18B is connected to the other side of the gate lines 14 and sequentially supplies the gate pulse signal to the gate lines 14. In another aspect, the first GIP circuit 18A may be connected to some of the gate lines 14 and sequentially supplies the gate pulse signal to the corresponding gate lines 14. The second GIP circuit 18B may be connected to gate lines other than the gate lines connected to the first GIP circuit 18A and sequentially supplies the gate pulse signal to the corresponding gate lines 14. The GIP circuits 18A and 18B may be distributed and arranged in the pixel array. The first and second GIP circuits 18A and 18B are synchronized through the timing controller 20.

The GIP circuits 18A and 18B receive the gate timing control signal through the level shifter LS and are provided with VGH and VGL. The GIP circuits 18A and 18B shift the gate pulse signal in response to a shift clock CLK and sequentially supply the gate pulse signal to the gate lines 14. The gate pulse signal swings between VGH and VGL. VGH is a voltage higher than a threshold voltage of a pixel TFT. VGL is a voltage lower than VGH and the threshold voltage of a pixel TFT. Pixel TFTs are turned on in response to VGH of the gate pulse signal to provide the data voltage from the data line 12 to pixel electrodes.

Figure 4:
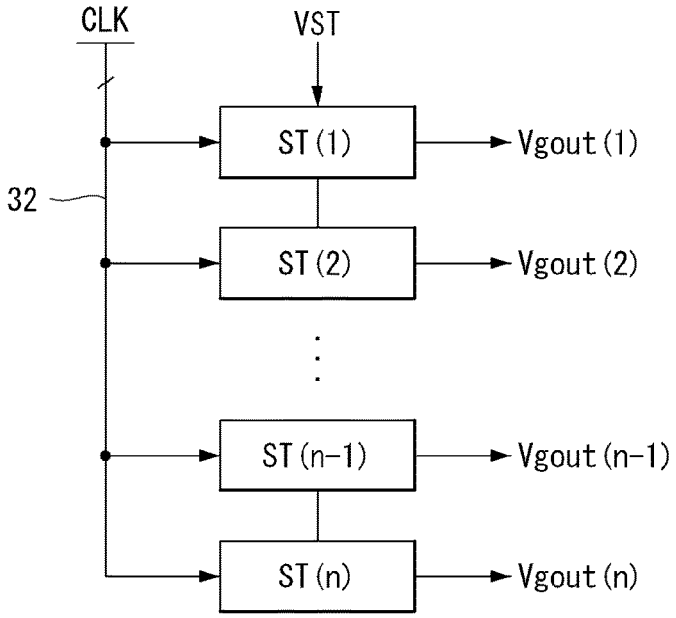
FIG. 4 is a schematic diagram illustrating a shift register.

A shift register of the GIP circuits 18A and 18B includes stages ST(1) to ST(n) which are cascade-connected to shift a gate pulse signal at shift clock timing, as shown in FIG. 4. In FIG. 4, reference numeral "32" indicates a clock line through which the shift clock CLK is transmitted to the GIP circuits. The stages ST(1) to ST(n) sequentially supply the gate pulse signal to the gate lines 14 and deliver a carry signal to other stages. The gate pulse signal and the carry signal may be the same signal output from each stage through a single output terminal or may be separately output from each stage through two output terminals.

The timing controller TCON transmits digital video data of an input image received from a host system (not shown) to the data driver SIC. The timing controller TCON receives timing signals such as a vertical synchronization signal Vsync, a horizontal synchronization signal Hsync, a data enable signal DE and a main clock signal MCLK received in synchronization with input video data and outputs a data timing control signal for controlling operation timing of the data driver SIC and a gate timing control signal for controlling operation timing of the GIP circuits 18A and 18B.

The gate timing control signal includes a start pulse signal VST, a shift clock signal CLK, and an output enable signal (i.e., gate output enable: GOE). The output enable signal GOE may be omitted. The start pulse signal VST is input through a VST terminal to the first stage of the GIP circuits 18A and 18B and controls output timing of a first gate pulse initially generated in one period. The shift clock signal CLK controls output timing of the gate pulse in each stage of the GIP circuits 18A and 18B to control shift timing of the gate pulse. The shift clock signal CLK may be generated as a clock signal having two or more phases. The gate timing control signal voltage is shifted to a voltage swinging between VGH and VGL through the left shifter 22.

The timing controller 20, the level shifter 22 and a power module integrated circuit (PMIC), which is not shown, are mounted on the PCB 30. The PMIC generates driving voltages necessary to drive the display panel, such as a gamma reference voltage, VGH, VGL, Vcom, etc. The PCB 30 includes a terminal 26 connected to a measurement device in the GIP characteristic measurement mode. A resistance value of a large transistor of the GIP circuits 18A and 18B is measured through the terminal 26.

The host system may be implemented as one of a television system, a set-top box, a navigation system, a DVD player, a Blu-ray player, a personal computer (PC), a home theater system and a phone system. The home system converts digital video data of an input image into a format suitable for display on the display panel PNL. The host system transmits timing signals Vsync, Hsync, DE and MCLK along with the digital video data of the input image to the timing controller TCON. The timing signals Vsync, Hsync, DE and MCLK include a vertical synchronization signal Vsync, a horizontal synchronization signal, a data enable signal DE, a main clock signal MCLK, etc. The host system executes an application program associated with coordinate information of touch input received from a touch sensing circuit (not shown).

Figure 5:
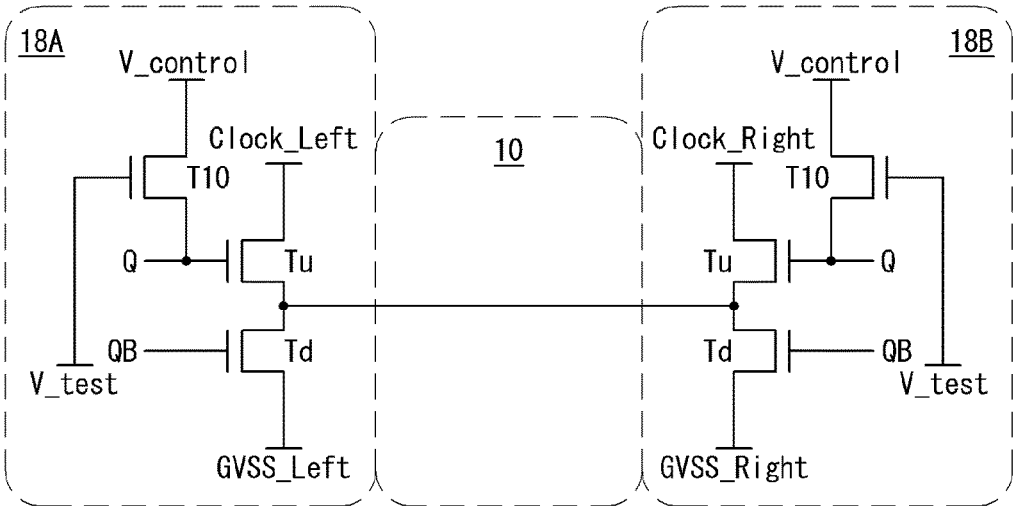
FIG. 5 is a circuit diagram of GIP circuits according to an aspect of the present disclosure.
Figure 10:
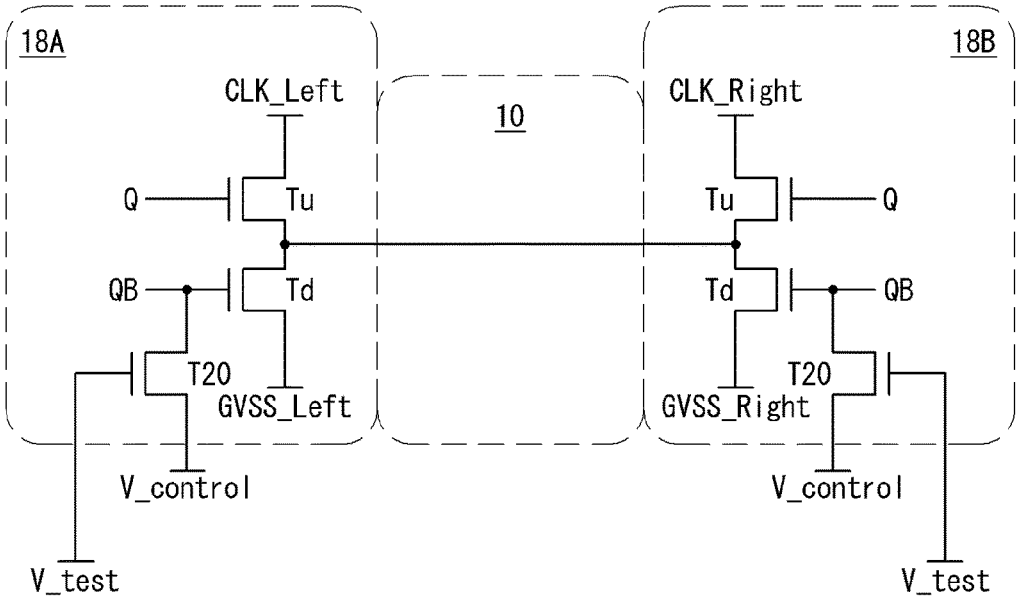
FIG. 10 is a circuit diagram of GIP circuits according to another aspect of the present disclosure.
Figure 12:
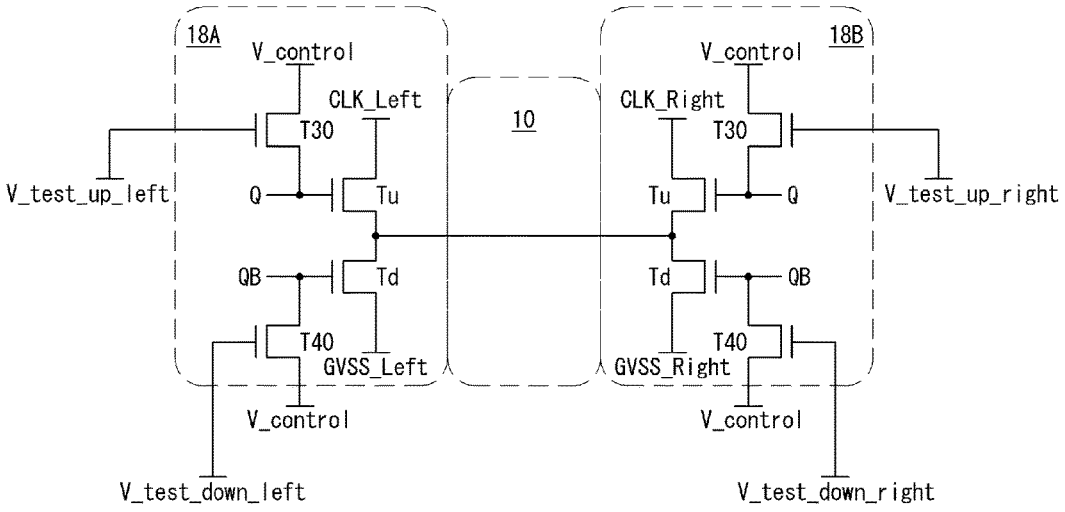
FIG. 12 is a circuit diagram of a GIP circuit according to yet another aspect of the present disclosure.

The present disclosure adds one or more test transistors to the GIP circuits 18A and 18B as shown in FIGS. 5, 10 and 12.

FIG. 5 is a circuit diagram of a GIP circuit according to an aspect of the present disclosure. In FIG. 5, a switch circuit which charges/discharges a Q node and a QB node is omitted. The switching circuit can be implemented as any known circuit. Although NMOSs will be described as transistors of the GIP circuit, the present disclosure is not limited thereto.

Referring to FIG. 5, each stage of the GIP circuits 18A and 18B includes a pull-up transistor Tu which charges an output terminal in response to a voltage of the Q node to increase an output voltage, a pull-down transistor Td which discharges the output terminal in response to a voltage of the QB node to decrease the output voltage, and a switch circuit which charges/discharges the Q node and the QB node. The output terminal is connected to the gate line 14 of the display panel PNL. The output voltage is applied to the gate line 14 as an n-th gate pulse.

The pull-up transistor Tu charges the output terminal with VGH of the shift clock signal CLK_Left or CLK_Right when the shift clock signal CLK_Left or CLK_Right is input to a drain in a state in which the Q node is precharged by VGH. The pull-up transistor Tu includes a gate connected to the Q node, a first electrode connected to a CLK terminal to which the shift clock signal CLK_Left or CLK_Right is applied, and a second electrode connected to the gate line 14 through the output terminal.

The pull-down transistor Td connects the output terminal to a GVSS terminal GVSS_Left or GVSS_Right to which VGL is applied when a QB voltage is charged by VGH to discharge the voltage of the output terminal to VGL. The pull-down transistor Td includes a gate connected to the QB node, a first electrode connected to the gate line 14 through the output terminal, and a second electrode connected to the GVSS line.

The GIP circuits 18A and 18B further include a test transistor T10. The test transistor T10 is turned on in response to a gate on voltage of a test enable signal V_test when the resistance of the pull-up transistor Tu is measured in the GIP characteristic measurement mode. The test transistor T10 need not necessarily be connected to all pull-up transistors. Accordingly, one or more test transistors T10 can be formed in each of the first and second GIP circuits 18A and 18B. The test transistor T10 includes a gate to which the test enable signal V_test is applied, a first electrode to which a test control voltage V_control is applied, and a second electrode connected to a Q node.

Figure 6:
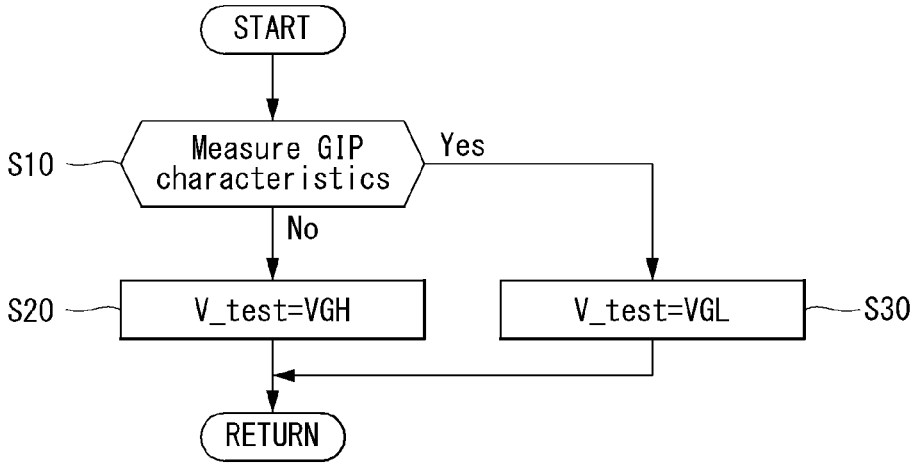
FIG. 6 is a flowchart illustrating a method of setting a test enable signal V_test in a GIP characteristic measurement mode and a normal driving mode in a display device of the present disclosure.

As shown in FIG. 6, in the GIP characteristic measurement mode S10, the present disclosure applies the test enable signal V_test at an on level voltage to the GIP circuits (S20), forms a closed loop including the GIP circuits 18A and 18B for resistance measurement and measures resistances of large transistors. The gate on voltage is high enough to turn on the test transistor T10.

The present disclosure can measure characteristics of the large transistors, for example, a threshold value, current and the like, on the basis of the resistance value measured in the closed loop. The large transistors may include the pull-up transistor Tu and the pull-down transistor Td of the GIP circuits 18A and 18B. The example of FIG. 5 is an aspect in which characteristics of the pull-up transistor Tu are measured.

The present disclosure can reduce the voltage of the test enable signal V_test to an off level to control the test transistor to be turned off in the normal driving mode (S30). The gate off voltage is low enough to turn off the test transistor T10.

The gate on voltage is a voltage by which a transistor can be turned on and the gate off voltage is a voltage by which the transistor can be turned off. In the case of an NMOS, the gate on voltage may be VGH and the gate off voltage may be VGL. In the case of a PMOS, the gate on voltage may be VGL and the gate off voltage may be VGH. Although switch elements of the GIP circuits are described as NMOSs in the following, the present disclosure is not limited thereto.

The test enable signal V_test can be applied to the test transistor T10 through the timing controller 20 and the level shifter 22 or applied thereto through an additional line in the GIP characteristic measurement mode.

Figure 7:
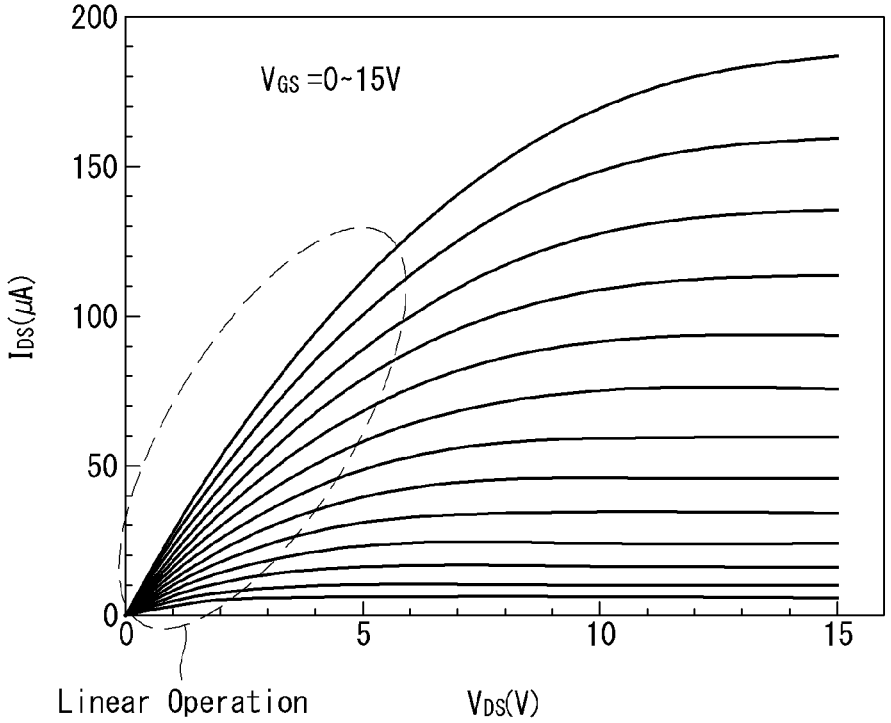
FIG. 7 illustrates a linear operation of a large transistor.

The test control voltage V_control can be set to a voltage in the range of 0 to 15V in order to measure resistance in a linear (or subthreshold) operation of the large transistors Tu and Td as shown in FIG. 7. The test control voltage V_control is applied to the gates of the large transistors Tu and Td through the test transistor T10 only in the GIP characteristic measurement mode.

Figure 8:
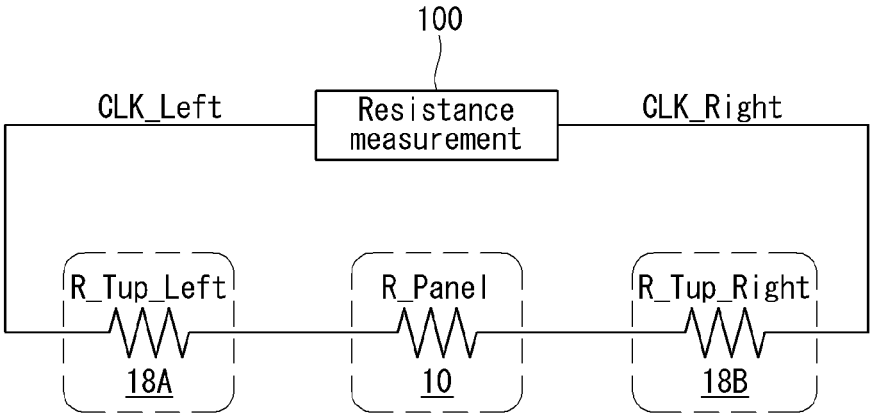
FIGS. 8 and 9 are circuit diagrams illustrating methods of measuring resistance of a pull-up transistor using the GIP circuits shown in FIG. 5.
Figure 9:
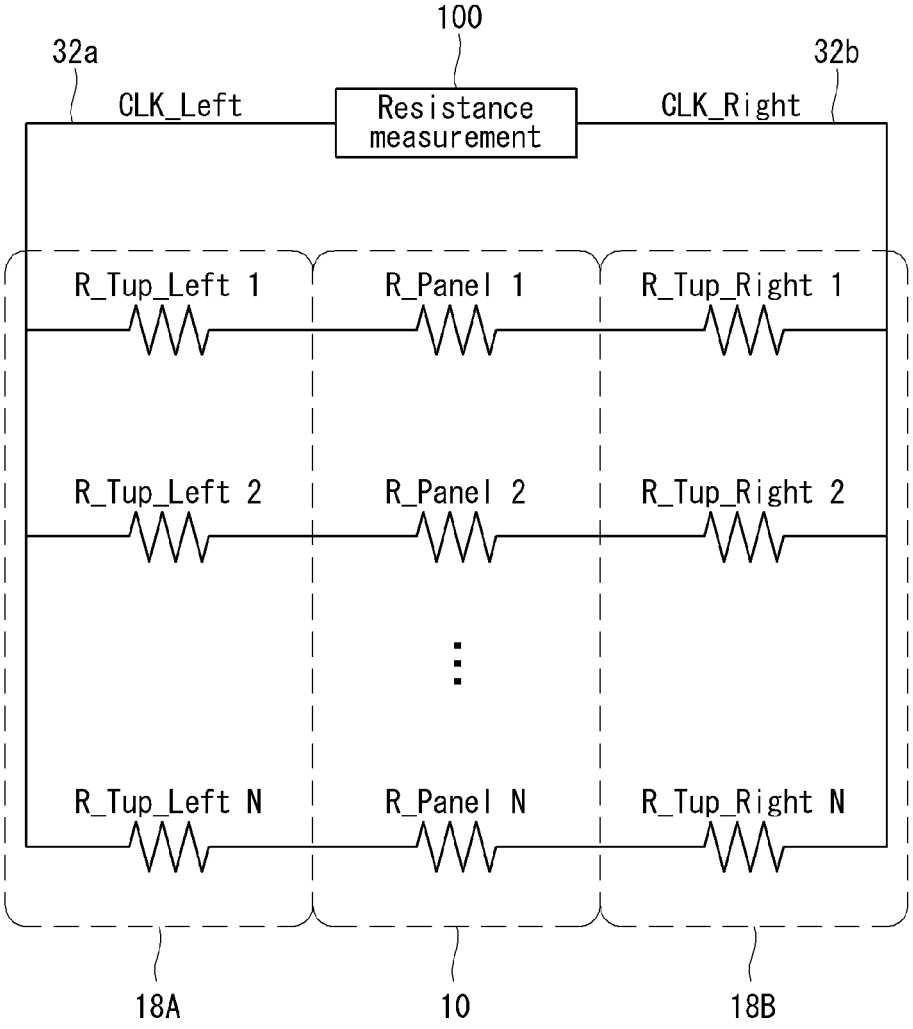

FIGS. 8 and 9 are circuit diagrams illustrating methods of measuring resistance of a pull-up transistor using the GIP circuits shown FIG. 5.

Referring to FIGS. 5, 8 and 9, the test transistor T10 is turned on by the test enable signal V_test in the GIP characteristic measurement mode. Here, a clock line 32*a* connected to the first GIP circuit 18A, the pull-up transistor Tu of the first GIP circuit 18A, the gate line 14 of the display panel PNL, the pull-up transistor Tu of the second GIP circuit 18B, and a clock line 32*b* connected to the second GIP circuit 18B are connected to form a closed loop.

A measurement device 100 measures the resistance of the closed loop through the terminal 26 on the closed loop. A known measurement device such as a digital multimeter can be used as the measurement device 10.

In the normal driving mode, the shift clock signal CLK or a DC voltage is applied to the clock lines 32*a* and 32*b* and the CLK terminals of the GIP circuits 18A and 18B. In the GIP characteristic measurement mode, a predetermined voltage or lower is applied from the measurement device 100 to the clock lines 32*a* and 32*b* through the terminal 26 in order to measure resistance.

In FIG. 8, "R_Tup_Left" and "R_Tup_Right" indicate pull-up transistor resistors of the first and second GIP circuits 18A and 18B, which are connected through one gate line 14. "R_Panel" indicates a resistor of the display panel PNL, that is, a resistor of the gate line 14, which is connected between the pull-up transistor Tu of the first GIP circuit 18A and the pull-up transistor Tu of the second GIP circuit 18B. The resistance R_Panel of the display panel PNL is considerably lower than the resistance of the pull-up transistor Tu and thus can be ignored. Accordingly, resistance of the closed loop circuit shown in FIG. 6 can be measured as follows.

$$\frac{1}{R_{measurement}} = \frac{1}{2\text{R_Tup}}$$

The present disclosure can compare the resistance value measured in the closed loop with a predetermined reference value to determine pull-up transistor characteristic deviation and determine whether the display panel is defective using the same. It is possible to determine whether the pull-up transistor is defective through a simple method of monitoring a difference between a reference value and a measured value. The reference value is a resistance value of a normally operating pull-up transistor and is a predetermined value. Further, the present disclosure may quantitatively calculate characteristics of the pull-up transistor by measuring the threshold voltage or current of the pull-up transistor on the basis of the measured resistance value as will be described below.

The test transistor shown in FIG. 5 can be provided to the stages of the GIP circuits 18A and 18B. As shown in FIG. 4, the plurality of pull-up transistors Tu of the GIP circuits 18A and 18B are connected to one clock line 32*a* or 32*b*. A pull-up transistor Tu is formed in each stage of the GIP circuits 18A and 18B and two or more stages are commonly connected to one clock line 32*a* or 32*b* to receive the shift clock signal CLK. In the GIP characteristic measurement mode, resistors R_Tup_Left 1 to N and R_Tup_Right 1 to N of the pull-up transistors connected through the clock lines 32*a* and 32*b* are connected in parallel in a closed loop. On the assumption that the resistors R_Tup_Left 1 to N and R_Tup_Right 1 to N of the pull-up transistors are equal, an average resistance is calculated as follows. Here, N is a positive integer equal to or greater than 2.

$$\frac{1}{R_{measurement}} = \frac{1}{2\text{R_Tup}} + \frac{1}{2\text{R_Tup}} + \ldots + \frac{1}{2\text{R_Tup}}$$

$$\frac{1}{R_{measurement}} = \frac{N}{2\text{R_Tup}}$$

$$\therefore \text{R_Tup} = \frac{NR_{measurement}}{2}$$

The present disclosure can compare the average resistance measured in the closed loop with a predetermined reference value to determine pull-up transistor characteristic deviation and determine whether the display panel is defective. Furthermore, the present disclosure may measure the threshold voltage or current of the pull-up transistors on the basis of the average resistance to quantitatively calculate characteristics of the pull-up transistors as will be described below. Such calculation may be performed by a computer connected to the display panel in the GIP characteristic measurement mode.

Drain-source current Ids of an MOSFET in a relational expression of drain-source current Ids and drain-source voltage Vds can be calculated by the below equation as follows.

$$I_{ds} = \frac{1}{2}\mu C_{ox}\left(\frac{W}{L}\right)[2(V_{gs} - V_{th})V_{ds} - V_{ds}^2]$$

Here, "μ" indicates mobility of the transistor, "Cox" indicates parasitic capacitance of the transistor, "W" indicates a channel width of the transistor, "L" indicates a channel length of the transistor and "Vth" indicates a threshold voltage of the transistor.

In the case of a linear operation, Vds is sufficiently low and thus the above equation can be represented as follows.

$$I_{ds} = \mu C_{ox}\left(\frac{W}{L}\right)[(V_{gs} - V_{th})V_{ds}]$$

On the basis of this equation and a resistance measurement value, the threshold voltage Vth of the transistor can be calculated as follows.

$$R_{ch} = \frac{V_{ds}}{I_{ds}}$$

$$V_{th} = V_{gs} - \frac{1}{R} \times \frac{1}{\mu C_{ox}\left(\frac{W}{L}\right)}$$

Figure 11:
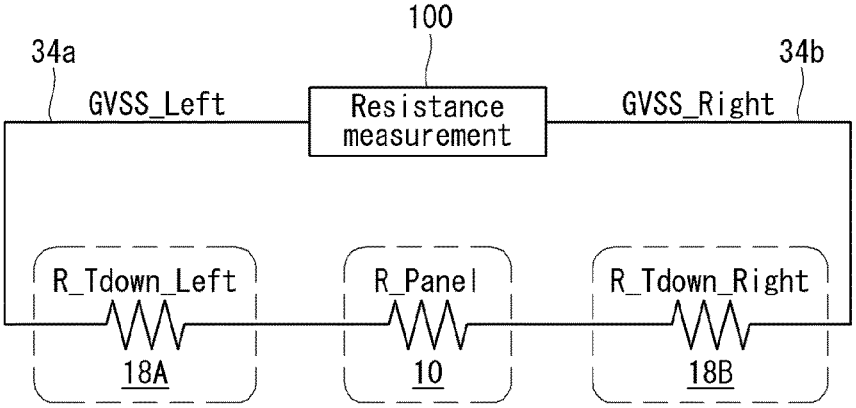
FIG. 11 is a circuit diagram illustrating a method of measuring resistance of a pull-down transistor using the GIP circuits shown in FIG. 10.

FIG. 10 is a circuit diagram of GIP circuits according to another aspect of the present disclosure. In FIG. 10, a switch circuit which charges/discharges a Q node and a QB node is omitted. The switching circuit can be implemented as any known circuit. In FIG. 10, components substantially the same as those of the circuit shown in FIG. 5 are indicated by the same reference numerals and detailed description thereof is omitted. FIG. 11 is a circuit diagram illustrating a method of measuring resistance of pull-down transistors using GIP circuits.

Referring to FIGS. 10 and 11, each of the GIP circuits 18A and 18B includes a plurality of pull-up transistors Tu, a plurality of pull-down transistors Td, and a test transistor T20 connected to the gate of the pull-down transistor Td through a QB node.

The test transistor T20 is turned on in response to a gate on voltage of a test enable signal V_test when the resistance of the pull-down transistor Td is measured in the GIP characteristic measurement mode. The test transistor T20 need not necessarily be connected to all pull-down transistors. Accordingly, one or more test transistors T20 can be formed in each of the first and second GIP circuits 18A and 18B. The test transistor T20 includes a gate to which the test enable signal V_test is applied, a first electrode connected to the QB node, and a second electrode to which a test control voltage V_control is applied.

The test transistor T20 is turned on by the test enable signal V_test in the GIP characteristic measurement mode. Here, a GVSS_Left line 34*a* connected to the first GIP circuit 18A, the pull-down transistor Td of the first GIP circuit 18A, the gate line 14 of the display panel PNL, the pull-down transistor Td of the second GIP circuit 18B, and a GVSS_Right line 34*b* connected to the second GIP circuit 18B are connected to form a closed loop. A gate off voltage, for example, VGL is applied to the GVSS_Left and Right lines 34*a* and 34*b*.

The measurement device 100 measures the resistance of the closed loop through the terminal 26 on the closed loop. In FIG. 11, "R_Tdown_Left" and "R_Tdown_Right" indicate pull-down transistor resistors of the first and second GIP circuits 18A and 18B which are connected through one gate line 14. "R_Panel" indicates a resistor of the display panel PNL connected between the pull-down transistor Td of the first GIP circuit 18A and the pull-down transistor Td of the second GIP circuit 18B. GVSS_Left and GVSS_Right indicate gate off voltages applied to the GIP circuits.

The present disclosure can compare the resistance value measured in the closed loop with a predetermined reference value to determine pull-down transistor characteristic deviation and determine whether the display panel is defective using the same. It is possible to determine whether the pull-down transistor is defective through a simple method of monitoring a difference between a reference value and a measured value. The reference value is a resistance value during normal operation and is a predetermined value. Further, the present disclosure may quantitatively calculate characteristics of the pull-down transistor by measuring the threshold voltage or current of the pull-down transistor on the basis of the measured resistance value as described above.

The test transistor can be provided to the stages of the GIP circuits 18A and 18B. The plurality of pull-down transistors Td of the GIP circuits 18A and 18B are connected to one of GVSS_Left and GVSS_Right lines 34*a* and 34*b*. A pull-down transistor Td is formed in each stage of the GIP circuits 18A and 18B and two or more stages are commonly connected to one of GVSS_Left and GVSS_Right lines 34*a* or 34*b*. In the GIP characteristic measurement mode, resistors of the pull-down transistors connected through the GVSS_Left and GVSS_Right lines 34*a* and 34*b* are connected in a closed loop. An average resistance is calculated on the assumption that the resistors of the pull-down transistors are equal. The threshold voltage and current of the pull-down transistor can be calculated on the basis of the average resistance.

Figure 13:
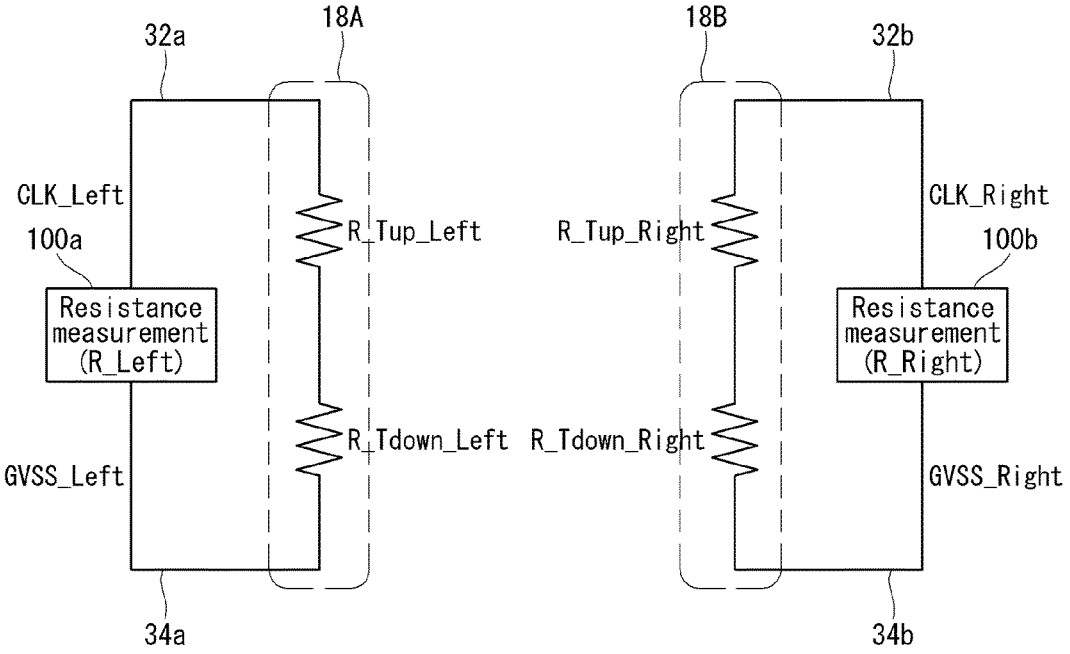
FIG. 13 is a circuit diagram illustrating a method of measuring resistance of a pull-up transistor and a pull-down transistor using the GIP circuits shown in FIG. 12.

FIG. 12 is a circuit diagram of GIP circuits according to yet another aspect of the present disclosure. In FIG. 12, a switch circuit which charges/discharges a Q node and a QB node is omitted. The switching circuit can be implemented as any known circuit. FIG. 13 is a circuit diagram illustrating a method of measuring resistance of pull-up transistors and pull-down transistors using GIP circuits. FIGS. 12 and 13 show a method of measuring resistance values of large transistors in a closed loop including resistors of pull-up transistors Tu and pull-down transistors Td in the GIP circuits 18A and 18B.

Referring to FIGS. 12 and 13, each of the GIP circuits 18A and 18B includes a plurality of pull-up transistors Tu, a plurality of pull-down transistors Td, a first test transistor T30 connected to the gate of the pull-up transistor Tu through a Q node, and a second test transistor T40 connected to the gate of the pull-down transistor Td through a QB node.

The first test transistor T30 is turned on in response to a gate on voltage of a test enable signal V_test in the GIP characteristic measurement mode. The first test transistor T30 need not necessarily be connected to all pull-up transistors. One or more first test transistor T30 can be formed in each of the first and second GIP circuits 18A and 18B. The first test transistor T30 includes a gate to which the test enable signal V_test is applied, a first electrode to which a test control voltage V_control is applied, and a second electrode connected to the Q node.

The second test transistor T40 is turned on in response to the gate on voltage of the test enable signal V_test in the GIP characteristic measurement mode. The second test transistor T40 need not necessarily be connected to all pull-down transistors. One or more second test transistors T20 can be formed in each of the first and second GIP circuits 18A and 18B. The second test transistor T40 includes a gate to which the test enable signal V_test is applied, a first electrode connected to the QB node, and a second electrode to which the test control voltage V_control is applied.

The first and second test transistors T30 and T40 are turned on by the test enable signal V_test in the GIP characteristic measurement mode. The clock line 32*a* connected to the first GIP circuit 18A, the pull-up transistor Tu of the first GIP circuit 18A, the pull-down transistor Td of the first GIP circuit 18A, and the GVSS line 34*a* connected to the first GIP circuit 18A are connected to form a closed loop. Similarly, the clock line 32*b* connected to the second GIP circuit 18B, the pull-up transistor Tu of the second GIP circuit 18B, the pull-down transistor Td of the second GIP circuit 18B, and the GVSS line 34*b* connected to the second GIP circuit 18B are connected to form a closed loop. The measurement device 100 measures resistances of the closed loops in the first and second GIP circuits 18A and 18B through the terminal 26 connected to each closed loop. In FIG. 13, "R_Tup_Left" and "R_Tup_Right" indicate pull-up transistor resistors and "R_Tdown_Left" and "R_Tdown_Right" indicate pull-down transistor resistors.

The present disclosure can compare the resistance value measured in the closed loop of each of the GIP circuits 18A and 18B with a predetermined reference value to determine characteristic deviation of large transistors Tu and Td and determine whether the display panel is defective using the same. It is possible to determine whether the large transistors Tu and Td are defective through a simple method of monitoring a difference between a reference value and a measured value. The reference value is a resistance value during normal operation and is a predetermined value. Further, the present disclosure may quantitatively calculate characteristics of the large transistors Tu and Td by measuring the threshold voltages or currents of the large transistors Tu and Td on the basis of the measured resistance values as described above.

The test transistors can be provided to the stages of the GIP circuits 18A and 18B. Large transistors Tu and Td are formed in each stage of the GIP circuits 18A and 18B and two or more stages are commonly connected to the clock lines 32*a* and 32*b* and the GVSS lines 34*a* and 34*b*. In the GIP characteristic measurement mode, resistors of the large transistors connected through the clock lines and the GVSS lines are connected in a closed loop. Average resistance is calculated on the assumption that the resistors of the large transistors are equal. The threshold voltages and currents of the large transistors Tu and Td can be calculated on the basis of the average resistance.

Figure 14:
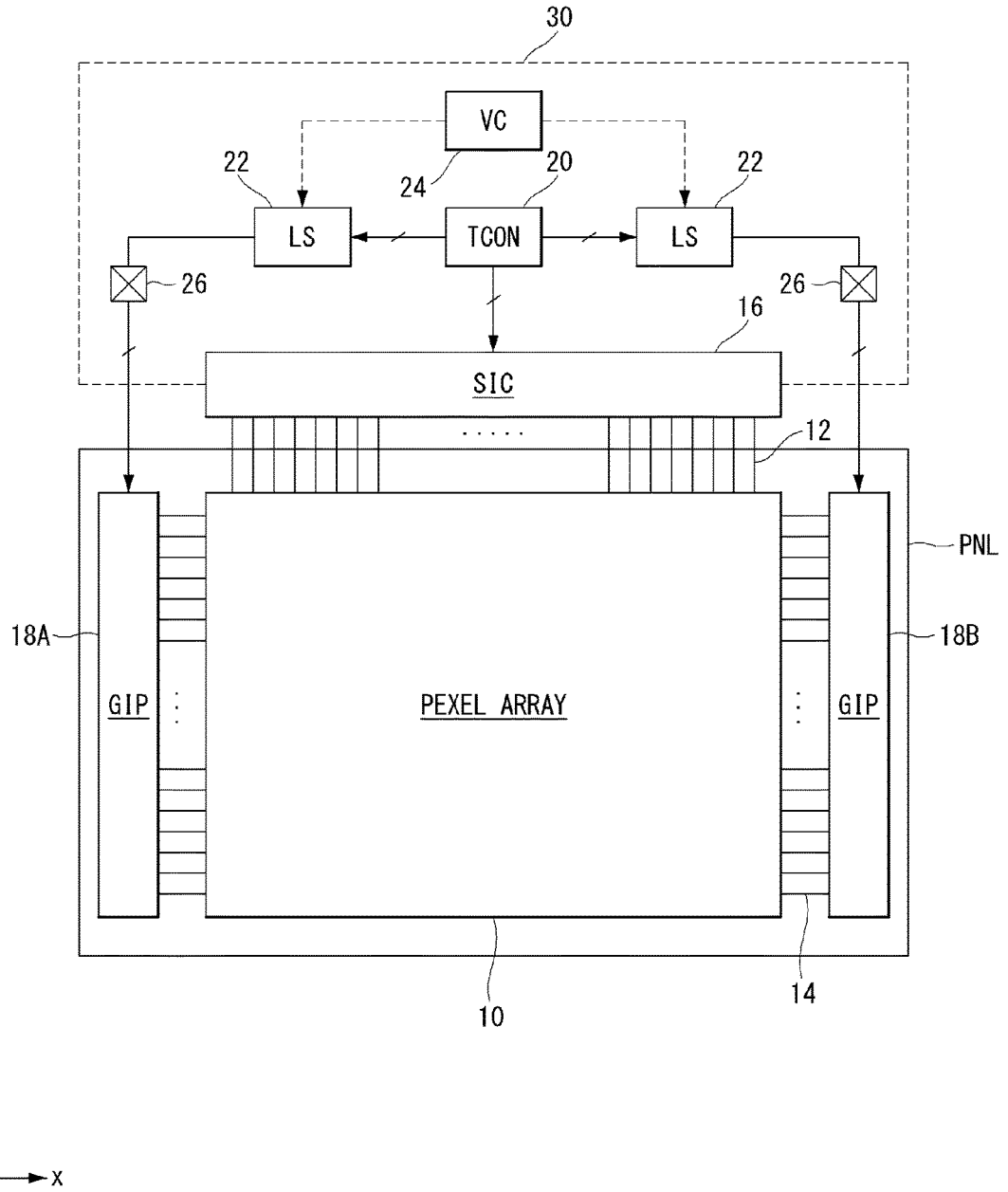
FIG. 14 is a block diagram of a display device according to another aspect of the present disclosure.

The present disclosure can adjust a gate timing signal voltage, gate on/off voltage and the like applied to the large transistors Tu and Td on the basis of a result of quantitative calculation of characteristics of the large transistors Tu and Td in the GIP circuits 18A and 18B to compensate for operation characteristic deviation of the transistors Tu and Td. To this end, the present disclosure can adjust the timing control signal voltage and the gate on/off voltage output from the level shifter 22 by controlling the level shifter 22 and a PMIC which is not shown using a voltage controller 24 as shown in FIG. 14.

As described above, the present disclosure can monitor characteristics of large transistors in GIP circuits embedded in the display panel without destructive analysis. In addition, the present disclosure can determine the characteristics of the large transistors of the GIP circuits rapidly and correctly through a method of directly measuring resistances of the GIP circuits without displaying a test pattern image on the display panel.

Although aspects have been described with reference to a number of illustrative aspects thereof, it should be understood that numerous other modifications and aspects can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display panel comprising:

a pixel array; and a first and second gate driving circuit connected with each other through a gate line on a substrate, each of the first and second gate driving circuits comprising:

a pull-up transistor connected to a clock line to which a clock signal is applied and turned on in response to a voltage of a Q node to increase a voltage of the gate line;

a pull-down transistor turned on in response to a voltage of a QB node to connect the gate line to a low voltage line to which a gate off voltage is applied to decrease the voltage of the gate line; and a test transistor connected to at least one of the pull-up transistor and the pull-down transistor, wherein the pull-up transistor, the pull-down transistor and the test transistor of each of the first and second gate driving circuits are disposed on the substrate of the display panel along with transistors for the pixel array displaying an input image, wherein the test transistor of each of the first and second gate driving circuits is turned on in response to a gate on voltage of a test enable signal generated in a measurement mode to form a closed loop including the pull-up transistors of the first and second gate driving circuits or the pull-down transistors of the first and second gate driving circuits.

2. The display panel according to claim 1, wherein each of the first and second gate driving circuits includes a plurality of pull-up transistors, a plurality of pull-down transistors and at least one test transistor.

3. The display panel according to claim 2, wherein the test transistor of each of the first and second gate driving circuits is turned on in response to the gate on voltage of the test enable signal in the measurement mode, and the test transistor of each of the first and second gate driving circuits has a gate to which the test enable signal is applied, a first electrode to which a test control voltage is applied, and a second electrode connected to the Q node, wherein the test control voltage is set to be a linear operation voltage of the pull-up transistor of the respective first and second gate driving circuits.

4. The display panel according to claim 3, wherein the closed loop comprises a first clock line connected to the first gate driving circuit, the pull-up transistor of the first gate driving circuit, the gate line, the pull-up transistor of the second gate driving circuit, and a second clock line connected to the second gate driving circuit, and resistance of the closed loop is measured by a measurement device in the measurement mode.

5. The display panel according to claim 2, wherein the test transistor of each of the first and second gate driving circuits is turned on in response to the gate on voltage of the test enable signal generated in the measurement mode, and the test transistor of each of the first and second gate driving circuits has a gate to which the test enable signal is applied, a first electrode connected to the QB node and a second electrode to which the test control voltage is applied, wherein the test control voltage is set to be a linear operation voltage of the pull-down transistor of the respective first and second gate driving circuits.

6. The display panel according to claim 5, wherein the closed loop comprises a low voltage line connected to the first gate driving circuit, the pull-down transistor of the first gate driving circuit, the gate line, the pull-down transistor of the second gate driving circuit, and the low voltage line connected to the second gate driving circuit, and resistance of the closed loop is measured by a measurement device in the measurement mode.

7. The display panel according to claim 1, further comprising a voltage controller for controlling voltages applied to the pull-up transistor and the pull-down transistor based on a result of measurement of resistance of at least one of the pull-up transistor and the pull-down transistor of the respective first and second gate driving circuits.

8. The display panel according to claim 7, wherein the voltage controller adjusts a gate timing control signal voltage and the gate on/off voltages to compensate for an operation characteristic deviation of the pull-up transistor and the and the pull-down transistor of the respective first and second gate driving circuits.

9. The display panel according to claim 4, further comprising a terminal connected to the measurement device in the measurement mode to measure the resistance of the closed loop.

10. A display panel comprising at least one gate driving circuit, a data driving circuit and a pixel array, the at least one gate driving circuit and the data driving circuit respectively connected to the pixel array by a gate line and a data line, the at least one gate driving circuit comprising:

a pull-up transistor connected to a clock line and turned on by a voltage of a Q node and increasing a voltage of the gate line;

a pull-down transistor connecting the gate line to a low voltage line where a gate off voltage is applied, turned on by a voltage of a QB node and decreasing the voltage of the gate line; and a first test transistor connected to one of the pull-up transistor and the pull-down transistor and a second transistor connected to the other of the pull-up transistor and the pull-down transistor, the first and second test transistors turned on by a gate on voltage of a test enable signal generated in a measurement mode, wherein the pull-up transistor and the pull-down transistor form a closed loop when a resistance of the closed loop is measured in the measurement mode and the resistance of the closed loop is used to determine whether at least one of the pull-up transistor and the pull-down transistor is defective.

11. The display panel according to claim 10, wherein the first test transistor has a gate to which the test enable signal is applied, a first electrode to which the test control voltage is applied and a second electrode connected to the Q node, wherein the second test transistor has a gate to which the test enable signal is applied, a first electrode connected to the QB node and a second electrode to which the test control voltage is applied, wherein the test control voltage is set to be linear operation voltages of the pull-up transistor and the pull-down transistor.

12. The display panel according to claim 11, wherein the at least one gate driving circuit comprises a first gate driving circuit and a second gate driving circuit;

wherein the closed loop comprises:

a first closed loop including a first clock line connected to the first gate driving circuit, the pull-up transistor of the first gate driving circuit, the pull-down transistor of the first gate driving circuit and a low voltage line connected to the first gate driving circuit; and a second closed loop including a second clock line connected to the second gate driving circuit, the pull-up transistor of the second gate driving circuit, the pull-down transistor of the second gate driving circuit and a low voltage line connected to the second gate driving circuit, wherein resistances of the first and second closes loops are measured by a measurement device in the measurement mode.

13. The display panel according to claim 10, wherein the pull-up transistor and the pull-down transistor are applied by voltages adjusted based on the measured resistance of at least one of the pull-up transistor and the pull-down transistor.

14. The display panel according to claim 10, further comprising a printed circuit board connected to the at least one gate driving circuit and the data driving circuit.

15. The display panel according to claim 14, wherein the printed circuit board comprises a timing controller, a level shifter, a power module integrated circuit and a terminal.

16. The display panel according to claim 15, wherein the power module integrated circuit generates a gamma reference voltage, a gate high voltage, a gate low voltage and a common voltage to drive the display panel.

17. The display panel according to claim 15, wherein the terminal connected to a measurement device in the measurement mode to measure the resistance of the closed loop.

18. The display panel according to claim 14, wherein the printed circuit board further comprises a voltage controller adjusting a gate timing control signal voltage and gate on/off voltages to compensate for an operation characteristic deviation of the pull-up transistor and the and the pull-down transistor.

19. A method of monitoring characteristics of at least one gate driving circuit including a pull-up transistor connected to a clock line to which a clock signal is applied and turned on in response to a voltage of a Q node to increase a voltage of a gate line, a pull-down transistor turned on in response to a voltage of a QB node to connect the gate line to a low voltage line to which a gate off voltage is applied to decrease the voltage of the gate line, and at least one test transistor connected to at least one of the pull-up transistor and the pull-down transistor, and arranged on a display panel, comprising:

forming a closed loop including at least one of:

the pull-up transistor, the pull-down transistor, and the at least one test transistor, wherein the at least one test transistor includes a first test transistor connected to one of the pull-up transistor and the pull-down transistor, and a second test transistor connected to the other of the pull-up transistor and the pull-down transistor; or one of the pull-up transistor and the pull-down transistor and the at least one test transistor, wherein the at least one gate driver circuit includes a first and a second gate driving circuit and the one of the pull-up transistor and the pull-down transistor and the at least one test transistor of each of the first and second gate driver circuits are connected via a gate line;

measuring a resistance of the closed loop; and determining whether at least one of the pull-up transistor and the pull-down transistor is defective based on the resistance of the closed loop.

20. The method according to claim 19, further comprising adjusting voltages applied to the pull-up transistor and the pull-down transistor based on the measured resistance of at least one of the pull-up transistor and the pull-down transistor.

* * * * *